US010016049B1

(12) United States Patent
Francillon

(10) Patent No.: US 10,016,049 B1
(45) Date of Patent: Jul. 10, 2018

(54) PENCIL SHARPENER HOLDER ATTACHMENT

(71) Applicant: Alex Francillon, Tamarac, FL (US)

(72) Inventor: Alex Francillon, Tamarac, FL (US)

( * ) Notice: Subject to any disclaimer, the term of this patent is extended or adjusted under 35 U.S.C. 154(b) by 276 days.

(21) Appl. No.: 15/186,905

(22) Filed: Jun. 20, 2016

Related U.S. Application Data

(60) Provisional application No. 62/193,782, filed on Jul. 17, 2015.

(51) Int. Cl.
*A45F 5/00* (2006.01)
*A45F 5/02* (2006.01)
*B43L 23/08* (2006.01)

(52) U.S. Cl.
CPC ..... *A45F 5/00* (2013.01); *A45F 5/02* (2013.01); *B43L 23/08* (2013.01)

(58) Field of Classification Search
CPC ..... A45F 5/00; A45F 5/02; B43L 23/08
USPC ..... 224/191
See application file for complete search history.

(56) References Cited

U.S. PATENT DOCUMENTS 6,193,118 B1 2/2001 Kearl
2011/0179655 A1 7/2011 Lemieux

FOREIGN PATENT DOCUMENTS

CN 103653449 A 3/2014

*Primary Examiner* — Peter Helvey
(74) *Attorney, Agent, or Firm* — Glenn E. Gold, P.A.; Glenn E. Gold; David Colls

(57) ABSTRACT

A pencil sharpener holder attachment includes a plate having opposite front and rear sides and a continuous peripheral edge portion thereabout for attaching to an item worn by a user, a pencil sharpener holder body having front and rear housing portions at respective front and rear sides of the plate defining front and rear chambers open at rear and front sides of front and rear housing portions in communication with a central opening through the plate, and complementary interfitting structures interengaged with one another so as to attach the front and rear housing portions on respective front and rear sides of the plate such that the front and rear chambers form an elongated compartment storing a pencil sharpener extending through the central opening into both the front and rear chambers such that a pencil insertion orifice in the pencil sharpener aligns with an aperture in the front housing portion.

20 Claims, 8 Drawing Sheets

PENCIL SHARPENER HOLDER ATTACHMENT

CROSS REFERENCE(S) TO RELATED APPLICATION(S)

This U.S. non-provisional patent application claims the benefit of U.S. provisional patent application No. 62/193,782, filed on Jul. 17, 2015, and is hereby incorporated-by-reference herein its entirety.

FIELD OF THE INVENTION

The present invention relates to pencil sharpener ease of access, and, more particularly, is concerned with a pencil sharpener holder attachment.

BACKGROUND OF THE INVENTION

Pencil sharpeners for sale online and at retail stores are typically versions that are either held in one's hand during use, or fixed in one place such as on a desk during use. U.S. Pat. No. 2,702,022 discloses both of these pencil sharpener versions.

Both pencil sharpener versions have drawbacks. The handheld version must be carried about by the user so it is available when needed for use. This also makes it vulnerable to being misplaced or lost. The desk-mounted version requires that users have to go to where it is located and possibly wait in line to use it.

Accordingly, there remains a need in the art for an innovation that will overcome the deficiencies of past approaches and the problems that remain unsolved.

SUMMARY OF THE INVENTION

The present invention is directed to an innovation that overcomes the deficiencies of the known art and the problems that remain unsolved by providing a pencil sharpener holder attachment that enables storing a pencil sharpener so that it may be safely and securely incorporated with an accessory or article of apparel worn by a user so as to expose and orient the pencil sharpener in such manner that it is always readily available for use by the wearer when needed.

In one aspect of the present invention, a pencil sharpener holder attachment includes:

- a main support plate of a planar configuration and having opposite front and rear sides, a continuous peripheral edge portion bounding the front and rear sides and adapted for attaching to an item worn by a user, and a central opening therethrough between the front and rear sides and spaced radially inwardly from the continuous peripheral edge portion;
- a pencil sharpener holder body including
  - a front housing portion disposed at the front side of the main support plate and defining a front chamber being open at a rear side of the front housing portion in communication with the central opening of the main support plate,
  - an aperture through the front housing portion leading into the front chamber, and
  - a rear housing portion disposed at the rear side of the main support plate and defining a rear chamber being open at a front side of the rear housing portion in communication with the central opening of the main support plate; and
- a plurality of complementary interfitting structures interengaged with one another so as to attach the front and rear housing portions of the pencil sharpener holder body on respective front and rear sides of the main support plate such that the front and rear chambers of the respective front and rear housing portions form an elongated compartment for storing a pencil sharpener therein extending through the central opening of the main support plate into both the front and rear chambers adjacent respective front and rear sides of the main support plate such that a pencil insertion orifice in the pencil sharpener may align with the aperture in the front housing portion.

In another aspect of the present invention, the continuous peripheral edge portion bounding the front and rear sides of the main support plate has a series of spaced apart elements adapted for attaching the main support plate to an item worn by a user. The spaced apart elements are holes formed through the continuous peripheral edge portion of the main support plate. Also, a plug is insertable in and removable from the aperture through the upper portion of the front housing portion leading into the front chamber.

In another aspect of the present invention, a pencil sharpener holder attachment includes:

- a main support plate of a planar configuration and having opposite front and rear sides, a continuous peripheral edge portion bounding the front and rear sides and adapted for attaching to an item worn by a user, and an opening therethrough between the front and rear sides and spaced radially inwardly from the continuous peripheral edge portion;
- a pencil sharpener holder body including
  - a front housing portion disposed at the front side of the main support plate and defining a front chamber being open at a rear side of the front housing portion in communication with the central opening of the main support plate,
  - an aperture through the front housing portion leading into the front chamber, and
  - a rear housing portion disposed at the rear side of the main support plate and defining a rear chamber being open at a front side of the rear housing portion in communication with the central opening of the main support plate; and
- a plurality of complementary interfitting structures interengaged with one another so as to attach the front and rear housing portions of the pencil sharpener holder body on respective front and rear sides of the main support plate such that the front and rear chambers of the respective front and rear housing portions form an elongated compartment for storing a pencil sharpener therein extending through the central opening of the main support plate into both the front and rear chambers adjacent respective front and rear sides of the main support plate such that a pencil insertion orifice in the pencil sharpener may align with the aperture in the front housing portion;
- wherein the plurality of complementary interfitting structures include
  - a channel formed on the front side of the main support plate inwardly from the continuous peripheral edge portion, the channel extending along opposing side portions and a bottom portion of the continuous peripheral edge portion of the main support plate, and
  - a peripheral plate attached on and extending radially outward from a rear peripheral edge of the front housing portion surrounding the open rear side thereof, the peripheral plate being installed in a flush relationship along the front side of the main support plate slidably inserted parallel along the front side of the main support plate and interengaged with the channel on the front side of the main support plate so as to attach the front housing portion to the main support plate; and also wherein the continuous peripheral edge portion bounding the front and rear sides of the main support plate has a series of spaced apart elements in the form of holes adapted for attaching the main support plate and thereby the holder attachment to an item worn by a user.

In another aspect of the present invention, a pencil sharpener holder attachment includes:

a main support plate of a planar configuration and having opposite front and rear sides, a continuous peripheral edge portion bounding the front and rear sides and adapted for attaching to an item worn by a user and an opening therethrough between the front and rear sides and spaced radially inwardly from the continuous peripheral edge portion;

a pencil sharpener holder body including a front housing portion disposed at the front side of the main support plate and defining a front chamber being open at a rear side of the front housing portion in communication with the central opening of the main support plate, an aperture through an upper portion of the front housing portion leading into the front chamber, and a rear housing portion disposed at the rear side of the main support plate and defining a rear chamber being open at a front side of the rear housing portion in communication with the central opening of the main support plate; and a plurality of complementary interfitting structures interengaged with one another so as to attach the front and rear housing portions of the pencil sharpener holder body on said respective front and rear sides of the main support plate such that the front and rear chambers of the respective front and rear housing portions form an elongated compartment for storing a pencil sharpener therein extending through the central opening of the main support plate into both the front and rear chambers adjacent the front and rear sides of the main support plate such that a pencil insertion orifice in the pencil sharpener may align with the aperture in the front housing portion;

wherein the plurality of complementary interfitting structures includes a pair of slots spaced from and defined adjacent to opposite sides of the central opening_through the main plate, a rim attached on and extending radially outward from a front peripheral edge of the rear housing portion surrounding the open front side thereof, the rim having upper and lower rim portions spaced from one another by recesses formed therebetween in the rim along opposite edge portions of the open front side of the rear housing portion, the upper and lower rim portions being installed in a flush relationship with the rear side of the main support plate and overlapping upper and lower portions of the slots in the main support plate such that the recesses are coextensive with remaining portions of the slots in the main support plate not overlapped by the upper and lower rim portions, and a pair of connectors fitted through the remaining portions of the slots in the main support plate and the recesses in the rim on the rear housing portion and interconnected with the upper and lower rim portions thereof so as to attach the rear housing portion to the main support plate; and also wherein the continuous peripheral edge portion bounding the front and rear sides of the main support plate has a series of spaced apart elements in the form of holes adapted for attaching the main support plate and thereby the holder attachment to an item worn by a user.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
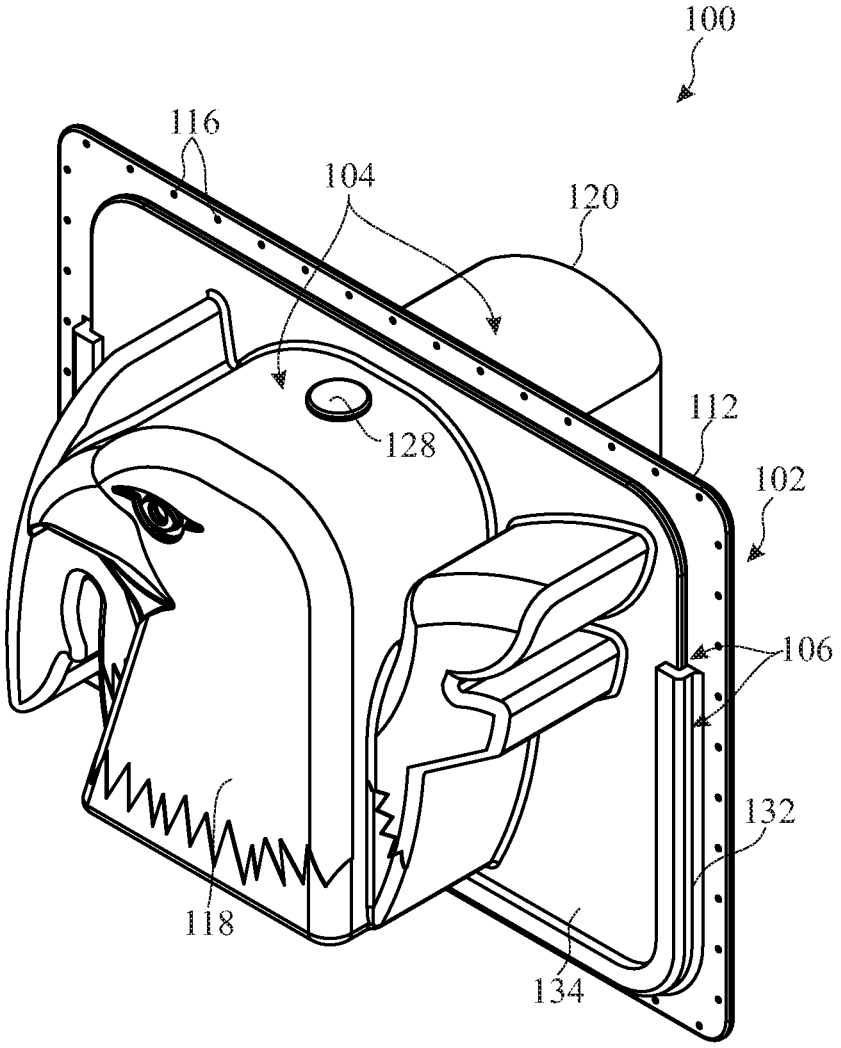
FIG. 1 presents a top front isometric assembled view of an exemplary embodiment of a pencil sharpener holder attachment in accordance with aspects of the present invention.
Figure 2:
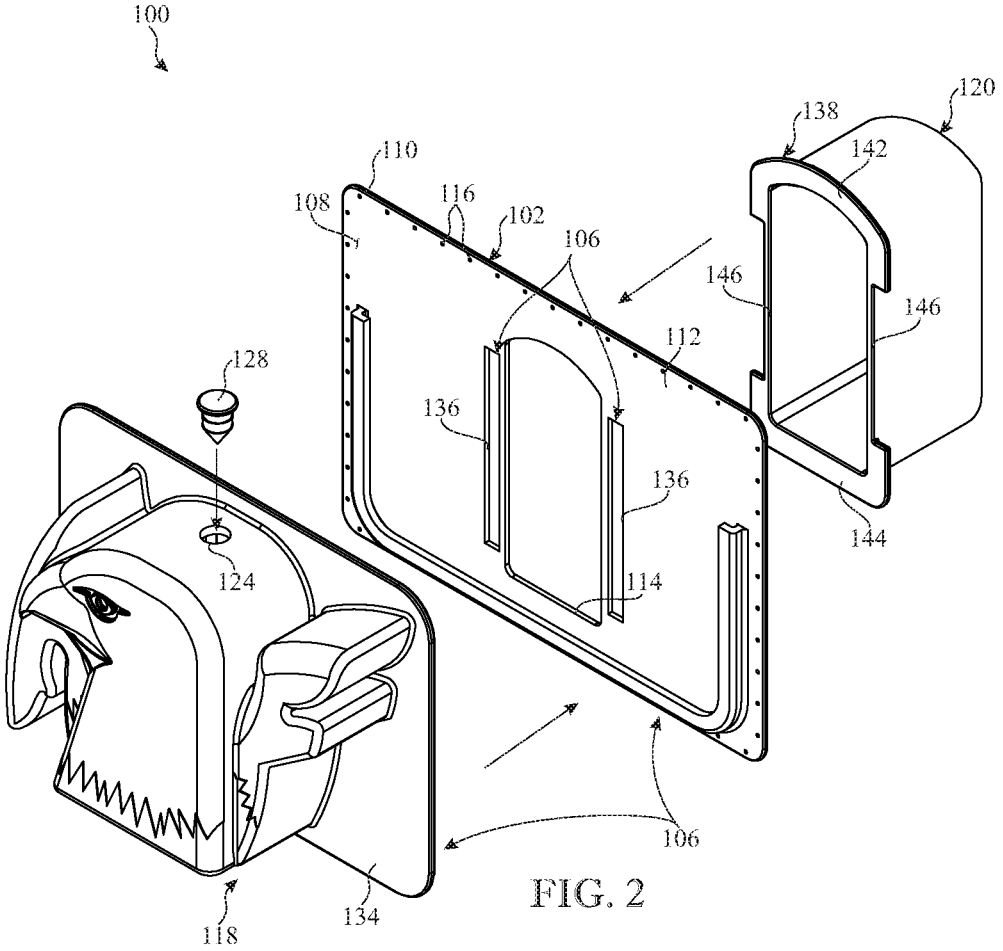
FIG. 2 presents a top front isometric exploded view of the pencil sharpener holder attachment originally introduced in FIG. 1.
Figure 3:
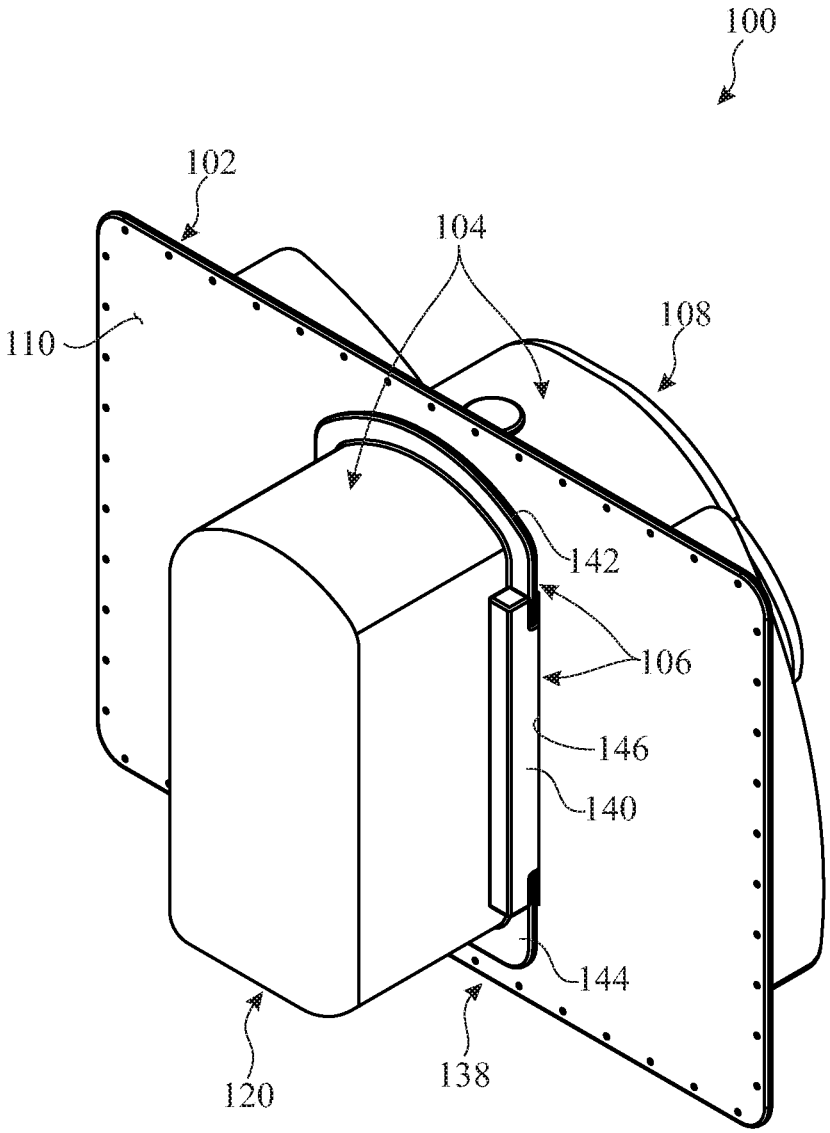
FIG. 3 presents a top rear isometric assembled view of the pencil sharpener holder attachment originally introduced in FIG. 1.
Figure 4:
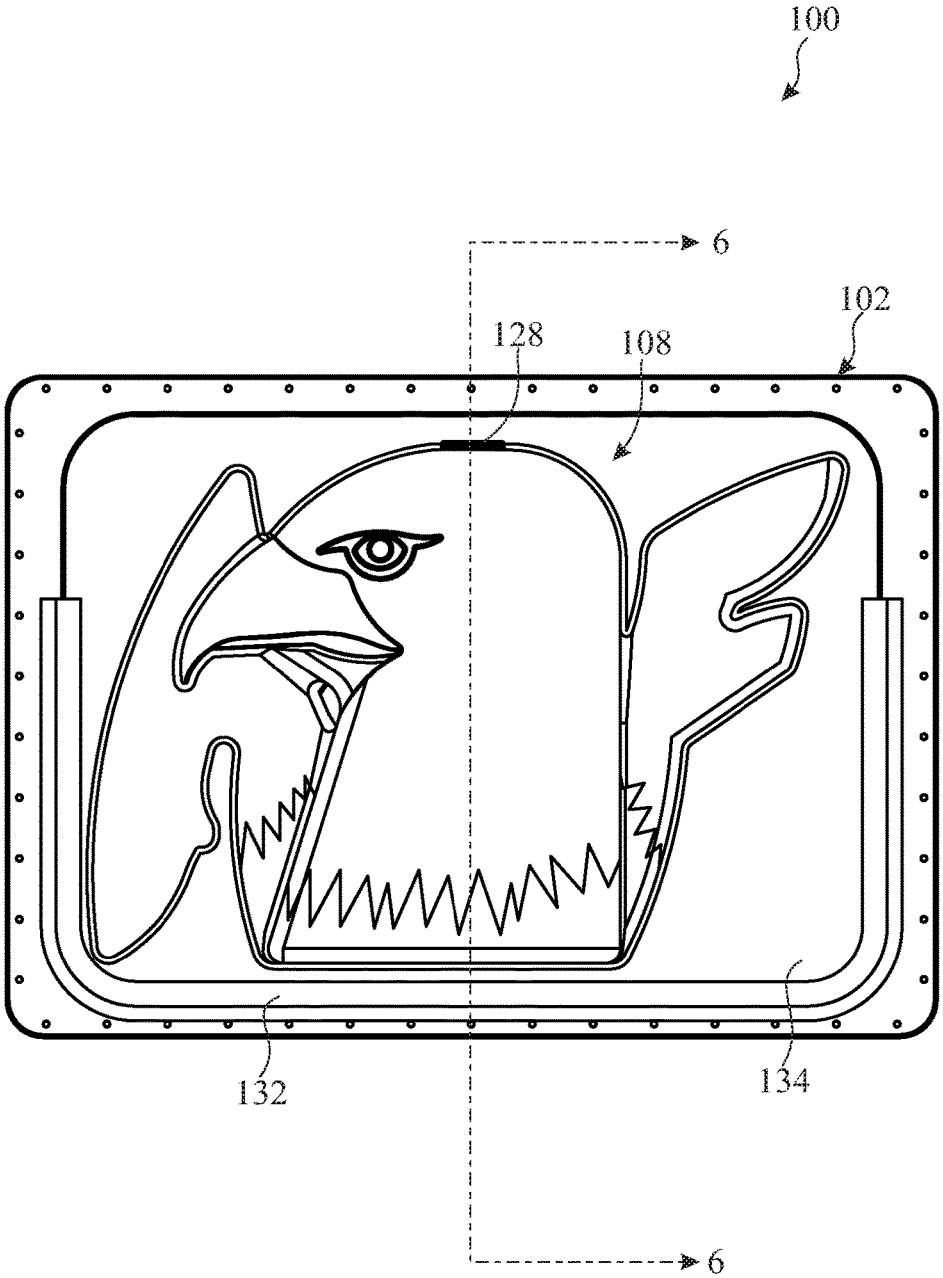
FIG. 4 presents a front plan view of the pencil sharpener holder attachment originally introduced in FIG. 1.
Figure 5:
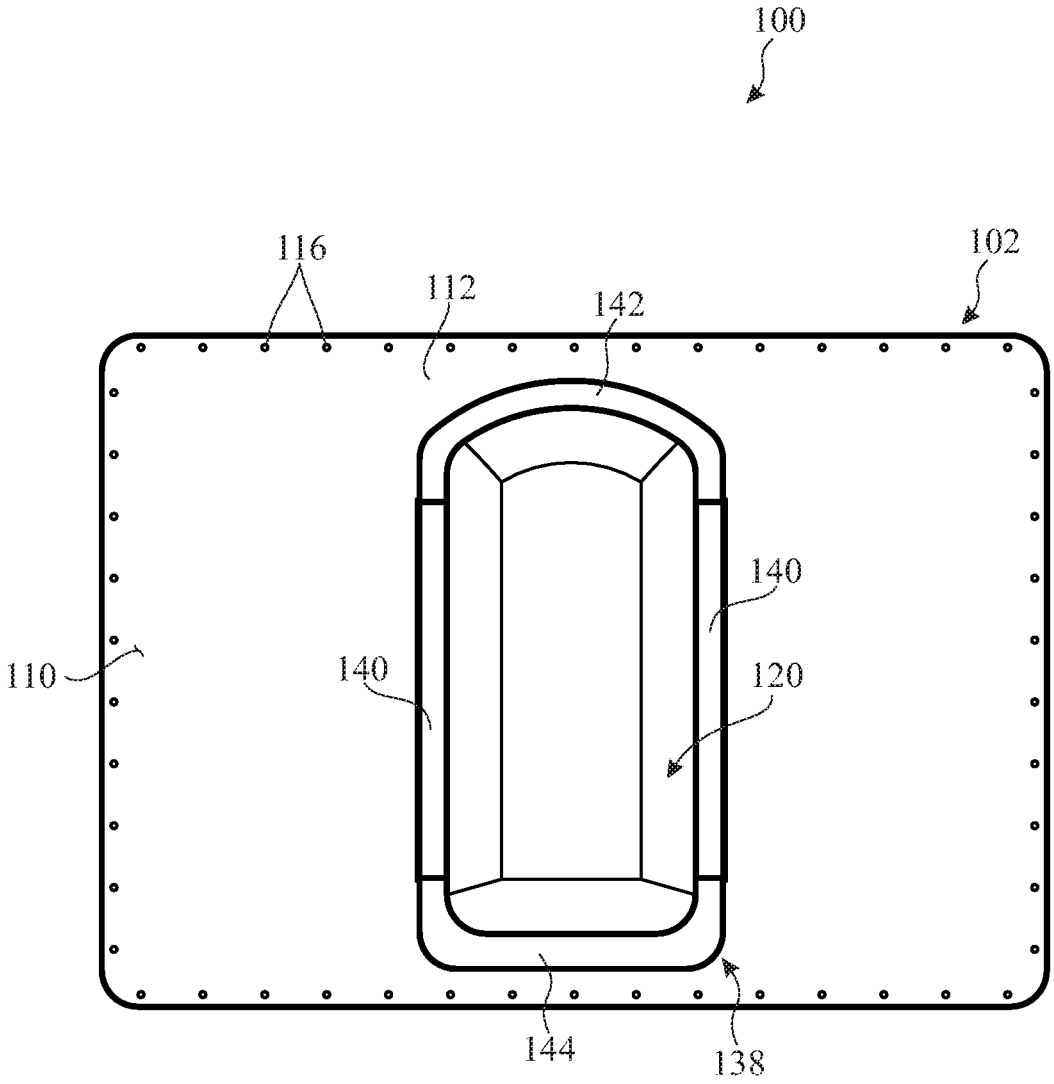
FIG. 5 presents a back plan view of the pencil sharpener holder attachment originally introduced in FIG. 1.
Figure 6:
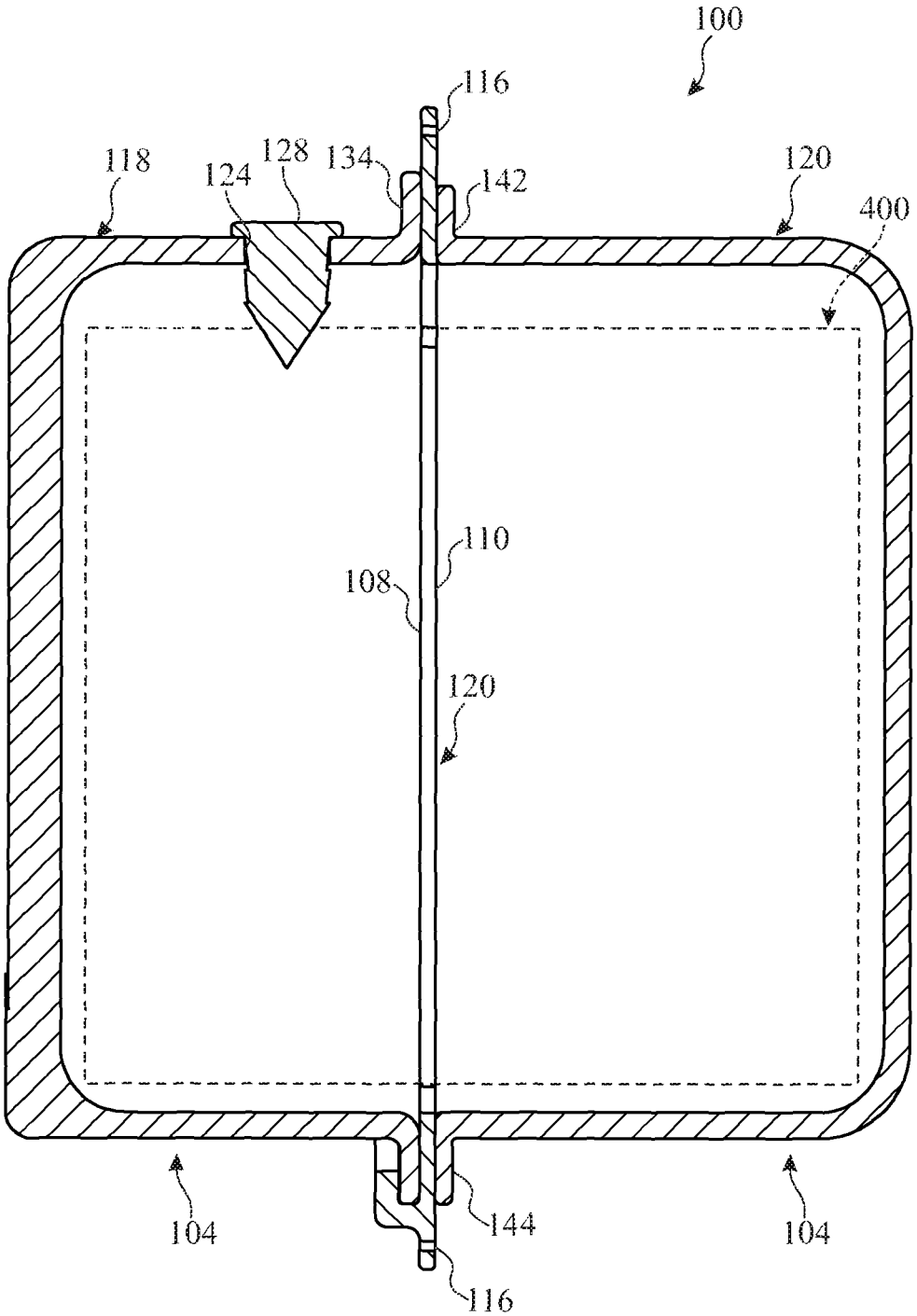
FIG. 6 presents a cross-sectional view of the pencil sharpener holder attachment originally introduced in FIG. 1 as taken along section line 6-6 in FIG. 4.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-6, there is illustrated an exemplary embodiment of a pencil sharpener holder attachment, generally designated 100. The pencil sharpener holder attachment 100 includes a main support plate 102, a pencil sharpener holder body 104, and a plurality of complementary interfitting structures 106. The main support plate 102, being of a planar configuration, has opposite front and rear sides 108, 110, a continuous peripheral edge portion 112, and a central opening 114 through the plate 102 between the front and rear sides thereof and spaced radially inwardly from the continuous peripheral edge portion. The continuous peripheral edge portion 112 thus encompasses or bounds the front and rear sides 108, 110 and is adapted for attaching the holder attachment 100 to an item worn by a user, for example, a backpack 200 (FIG. 7) and a pocket 302 on a leg 304 of a pair of trousers 300 (FIG. 8). By way of example, the continuous peripheral edge portion 112 of the main support plate 102 has series of spaced apart elements, such as in the form of holes 116 therethrough spaced radially outward from the central opening 114, being adapted for attaching the main support plate 102, and thus the holder attachment 100, to the aforementioned item worn by the user.

The pencil sharpener holder body 104 includes a multi-sided front housing portion 118 and a multi-sided rear housing portion 120 respectively disposed at the front and rear sides 108, 110 of the main support plate 102. The front housing portion 118 defines a front chamber 122 being open at a rear side of the front housing portion in communication with the central opening 114 of the main support plate 102. The front housing portion 118 also has an aperture 124 formed through an upper side portion thereof. The aperture 124 leads into the front chamber 122. The rear housing portion 120 defines a rear chamber 126 being open at a front side of the rear housing portion in communication with the central opening 114 of the main support plate 102. Also, a plug 128 is provided, being insertable in and removable from the aperture 124, to selectively cover the aperture.

Various ones of the plurality of complementary interfitting structures 106 interengage with one another so as to attach the front and rear housing portions 118, 120 of the pencil sharpener holder body 104 on respective front and rear sides 108, 110 of the main support plate 102. The front and rear chambers 122, 126 of the respective front and rear housing portions 118, 120 thereby form an elongated compartment 130 for storing a pencil sharpener 400 therein. The elongated compartment 130 extends through the central opening 114 of the main support plate 102 into both the front and rear chambers 122, 126 adjacent respective front and rear sides 108, 110 of the main support plate 102 such that a pencil insertion orifice 402 in the pencil sharpener 400 aligns with the aperture 124 in the front housing portion 118 and the plug 128 provided to selectively cover the aperture.

The plurality of complementary interfitting structures 106, in part, include a channel 132 on the main support plate 102 and a peripheral plate 134 on the front housing portion 118, The channel 132 is formed on the front side 108 of the main support plate 102 spaced inwardly from the continuous peripheral edge portion 112 and spaced outwardly from the central opening 114. The channel 132 extends along opposing side portions and a bottom portion of the continuous peripheral edge portion 112 of the main support plate 102. The peripheral plate 134 is attached on and extends radially outward from a rear peripheral edge of the front housing portion 118 surrounding the open rear side thereof. The peripheral plate 134 is installed in a flush relationship along the front side of the main support plate 102 slidably inserted parallel along the front side of the main support plate and interengaged with the channel 132 on the front side 108 of the main support plate 102 so as to attach the front housing portion 118 on the main support plate 102.

The plurality of complementary interfitting structures 106, in part, also include a pair of slots 136 spaced from and defined adjacent to opposite sides of the central opening 114 through the main plate 102, a rim 138 attached on and extending radially outward from a front peripheral edge of the rear housing portion 120 surrounding the open front side thereof, and a pair of connectors 140. The rim 138 has upper and lower rim portions 142, 144 spaced from one another by recesses 146 formed therebetween in the rim along opposite edge portions of the open front side of the rear housing portion 120. The upper and lower rim portions 142, 144 are installed in a flush relationship with the rear side 110 of the main support plate 102 and overlap upper and lower portions of the slots 136 in the main support plate 102 such that the recesses are coextensive with remaining portions of the slots 136 in the main support plate 102 not overlapped by the upper and lower rim portions 142, 144. The connectors 140 are fitted through the remaining portions of the slots 136 in the main support plate 102 and the recesses 146 in the rim 138 on the rear housing portion 120 and interconnected with the upper and lower rim portions 142, 144 thereof so as to attach the rear housing portion 120 to the main support plate 102.

The main support plate 102 and the pencil sharpener holder body 104 of the holder attachment 100, by way of example but not limitation, may be made of a suitable flexible or hard material, such as rubber. The front housing portion 118 may have an ornamental shape, such as that of an eagle head portion with wings in the shape of A and F. A forward portion of a pencil sharpener 400 can be slid through the central opening 114 of the main support plate 102 into the front housing portion 118 attached to the front side 108 of the main support plate. The rear housing portion 120 is then assembled over a rearward portion of the pencil sharpener 400, extending from the central opening 114 of the main support plate 102, and attached to rear side 110 of the main support plate. The pencil sharpener 400 may be a top-loading vertical design that is battery-operated. The holder attachment 100 is adapted to accommodate other versions of a pencil sharpener and may be water proof or water resistant.

Figure 7:
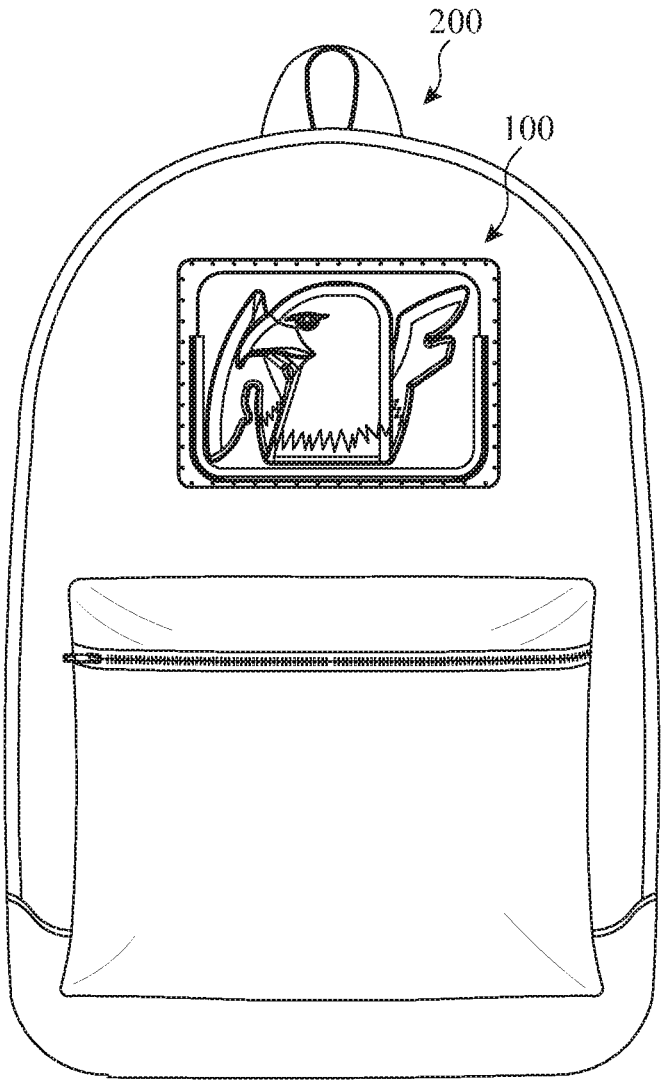
FIG. 7 presents a front plan view of the pencil sharpener holder attachment as previously presented in FIG. 4 being shown incorporated into a backpack worn by a user.
Figure 8:
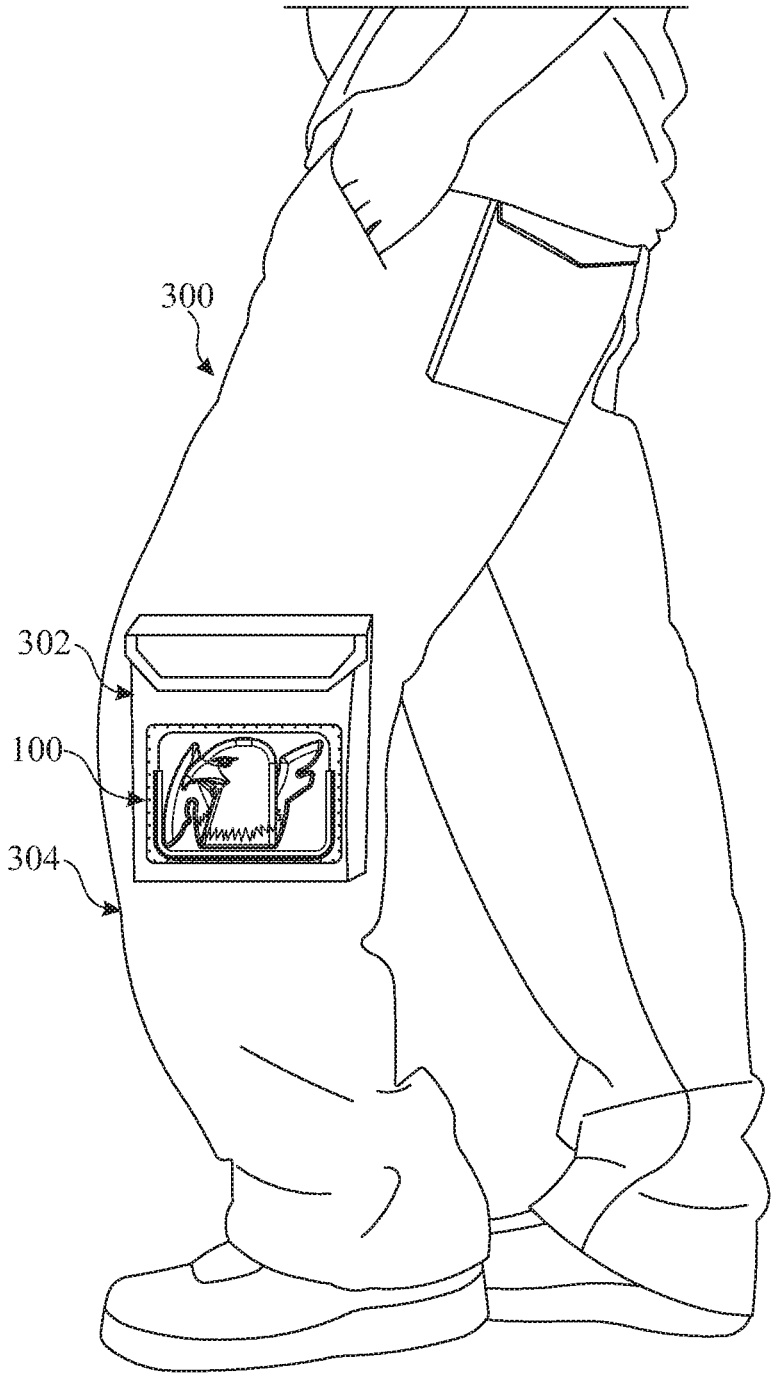
FIG. 8 presents a front plan view of the pencil sharpener holder attachment as previous presented in FIG. 4 being shown incorporated on a leg of pant trousers worn by a user.

As seen in FIGS. 7 and 8, the main support plate 102 may be sewn onto a selected worn item via the spaced apart holes 116 through the continuous peripheral edge portion 112 of the main support plate, with only the front housing portion 118 of the pencil sharpener holder body 104 and the front side 108 of the main support plate 102 being visible. Either an opening is made in the worn item to accommodate the rear housing portion 120 or a pouch or pocket may be used to mount the holder attachment 100.

To recapitulate, some of the advantages of the disclosed pencil sharpener holder attachment 100 are that: (1) it provides easy, repeated access to sharpen one's pencil as soon as needed; (2) there is no time lost searching to find where one's sharpener is located; (3) there is no time lost walking to, and waiting in line at, a desk where a pencil sharpener is located to sharpen one's pencil; (4) it enables providing different artistic designs on the front cover part of the attachment to reflect an individual user's personality; (5) by providing different supporting pieces to place within the storage compartment it allows use with alternative pencil sharpener models to sharpen various types of pencils; (6) it protects the pencil sharpener contained in the storage compartment from contact with corrosive substances; and (7) it is attachable to articles of clothing or school bags or backpacks so as to make the pencil sharpener portable.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A pencil sharpener holder attachment, comprising:

a main support plate of a planar configuration and having opposite front and rear sides, a continuous peripheral edge portion bounding said front and rear sides and adapted for attaching to an item worn by a user, and a central opening therethrough between the front and rear sides and spaced radially inwardly from said continuous peripheral edge portion;

a pencil sharpener holder body comprising a front housing portion disposed at said front side of said main support plate and defining a front chamber being open at a rear side of said front housing portion in communication with said central opening of said main support plate, an aperture through said front housing portion leading into said front chamber, and a rear housing portion disposed at said rear side of said main support plate and defining a rear chamber being open at a front side of said rear housing portion in communication with said central opening of said main support plate; and a plurality of complementary interfitting structures interengaged with one another so as to attach said front and rear housing portions of said pencil sharpener holder body on said respective front and rear sides of said main support plate such that said front and rear chambers of said respective front and rear housing portions form an elongated compartment for storing a pencil sharpener therein extending through said central opening of said main support plate into both said front and rear chambers adjacent said respective front and rear sides of said main support plate such that a pencil insertion orifice in the pencil sharpener may align with said aperture in said front housing portion.

2. The attachment of claim 1 wherein said plurality of complementary interfitting structures includes a channel formed on said front side of said main support plate inwardly from said continuous peripheral edge portion, said channel extending along opposing side portions and a bottom portion of said continuous peripheral edge of said main support plate.

3. The attachment of claim 2 wherein said plurality of complementary interfitting structures also includes a peripheral plate attached on and extending radially outward from a rear peripheral edge of said front housing portion surrounding said open rear side thereof, said peripheral plate being installed in a flush relationship along said front side of said main support plate slidably inserted parallel along said front side of said main support plate and interengaged with said channel on said front side of said main support plate so as to attach said front housing portion to said main support plate.

4. The attachment of claim 1 wherein said plurality of complementary interfitting structures further includes a pair of slots spaced from and defined adjacent to opposite sides of said central opening_through said main plate.

5. The attachment of claim 4 wherein said plurality of complementary interfitting structures further includes a rim attached on and extending radially outward from a front peripheral edge of said rear housing portion surrounding said open front side thereof, said rim having upper and lower rim portions spaced from one another by recesses formed therebetween in said rim along opposite edge portions of said open front side of said rear housing portion, said upper and lower rim portions being installed in a flush relationship with said rear side of said main support plate and overlapping upper and lower portions of said slots in said main support plate such that said recesses are coextensive with remaining portions of said slots in said main support plate not overlapped by said upper and lower rim portions.

6. The attachment of claim 5 wherein said plurality of complementary interfitting structures further includes a pair of connectors fitted through said remaining portions of said slots in said main support plate and said recesses in said rim on said rear housing portion and interconnected with said upper and lower rim portions thereof so as to attach said rear housing portion to said main support plate.

7. The attachment of claim 1 wherein said continuous peripheral edge portion bounding said front and rear sides of said main support plate has a series of spaced apart holes formed therethrough adapting said main support plate and thereby said holder attachment for attaching to an item worn by a user.

8. The attachment of claim 7 further comprising a plug insertable in and removable from said aperture through said front housing portion leading into said front chamber.

9. A pencil sharpener holder attachment, comprising:

a main support plate of a planar configuration and having opposite front and rear sides, a continuous peripheral edge portion bounding said front and rear sides and adapted for attaching to an item worn by a user, and an opening therethrough between said front and rear sides and spaced radially inwardly from said continuous peripheral edge portion;

a pencil sharpener holder body comprising a front housing portion disposed at said front side of said main support plate and defining a front chamber being open at a rear side of said front housing portion in communication with said central opening of said main support plate, an aperture through said front housing portion leading into said front chamber, and a rear housing portion disposed at said rear side of said main support plate and defining a rear chamber being open at a front side of said rear housing portion in communication with said central opening of said main support plate; and a plurality of complementary interfitting structures interengaged with one another so as to attach said front and rear housing portions of said pencil sharpener holder body on said respective front and rear sides of said main support plate such that said front and rear chambers of said respective front and rear housing portions form an elongated compartment for storing a pencil sharpener therein extending through said central opening of said main support plate into both said front and rear chambers adjacent said respective front and rear sides of said main support plate such that a pencil insertion orifice in the pencil sharpener may align with said aperture in said front housing portion;

wherein said plurality of complementary interfitting structures includes a channel formed on said front side of said main support plate inwardly from said continuous peripheral edge portion, said channel extending along opposing side portions and a bottom portion of said continuous peripheral edge portion of said main support plate; and a peripheral plate attached on and extending radially outward from a rear peripheral edge of said front housing portion surrounding said open rear side thereof, said peripheral plate being installed in a flush relationship along said front side of said main support plate slidably inserted parallel along said front side of said main support plate and interengaged with said channel on said front side of said main support plate so as to attach said front housing portion to said main support plate; and also wherein said continuous peripheral edge portion bounding said front and rear sides of said main support plate has a series of spaced apart elements adapted for attaching said main support plate and thereby said holder attachment to an item worn by a user.

10. The attachment of claim 9 wherein said spaced apart elements are holes formed through said continuous peripheral edge portion of said main support plate.

11. The attachment of claim 9 wherein said plurality of complementary interfitting structures further includes a pair of slots spaced from and defined adjacent to opposite sides of said central opening_through said main support plate.

12. The attachment of claim 11 wherein said plurality of complementary interfitting structures further includes a rim attached on and extending radially outward from a front peripheral edge of said rear housing portion surrounding said open front side thereof, said rim having upper and lower rim portions spaced from one another by recesses formed therebetween in said rim along opposite edge portions of said open front side of said rear housing portion, said upper and lower rim portions being installed in a flush relationship with said rear side of said main support plate and overlapping upper and lower portions of said slots in said main support plate such that said recesses are coextensive with remaining portions of said slots in said main support plate not overlapped by said upper and lower rim portions.

13. The attachment of claim 12 wherein said plurality of complementary interfitting structures further includes a pair of connectors fitted through said remaining portions of said slots in said main support plate and said recesses in said rim on said rear housing portion and interconnected with said upper and lower rim portions thereof so as to attach said rear housing portion to said main support plate.

14. The attachment of claim 9 wherein said front housing portion has an ornamental shape.

15. A pencil sharpener holder attachment, comprising:

a main support plate of a planar configuration and having opposite front and rear sides, a continuous peripheral edge portion bounding said front and rear sides and adapted for attaching to an item worn by a user, and a central opening therethrough between said front and rear sides and spaced radially inwardly from said continuous peripheral edge portion;

a pencil sharpener holder body comprising a front housing portion disposed at said front side of said main support plate and defining a front chamber being open at a rear side of said front housing portion in communication with said central opening of said main support plate, an aperture through said front housing portion leading into said front chamber, and a rear housing portion disposed at said rear side of said main support plate and defining a rear chamber being open at a front side of said rear housing portion in communication with said central opening of said main support plate; and a plurality of complementary interfitting structures interengaged with one another so as to attach said front and rear housing portions of said pencil sharpener holder body on said respective front and rear sides of said main support plate such that said front and rear chambers of said respective front and rear housing portions form an elongated compartment for storing a pencil sharpener therein extending through said central opening of said main support plate into both said front and rear chambers adjacent said respective front and rear sides of said main support plate such that a pencil insertion orifice in the pencil sharpener may align with said aperture in said front housing portion;

wherein said plurality of complementary interfitting structures includes a pair of slots spaced from and defined adjacent to opposite sides of said central opening_through said main plate, a rim attached on and extending radially outward from a front peripheral edge of said rear housing portion surrounding said open front side thereof, said rim having upper and lower rim portions spaced from one another by recesses formed therebetween in said rim along opposite edge portions of said open front side of said rear housing portion, said upper and lower rim portions being installed in a flush relationship with said rear side of said main support plate and overlapping upper and lower portions of said slots in said main support plate such that said recesses are coextensive with remaining portions of said slots in said main support plate not overlapped by said upper and lower rim portions, and a pair of connectors fitted through said remaining portions of said slots in said main support plate and said recesses in said rim on said rear housing portion and interconnected with said upper and lower rim portions thereof so as to attach said rear housing portion to said main support plate; and also wherein said continuous peripheral edge portion bounding said front and rear sides of said main support plate has a series of spaced apart elements adapted for attaching said main support plate and thereby said holder attachment to an item worn by a user.

16. The attachment of claim 15 wherein said spaced apart elements are holes formed through said continuous peripheral edge portion of said main support plate.

17. The attachment of claim 15 wherein said plurality of complementary interfitting structures includes a channel formed on said front side of said main support plate spaced inwardly from said continuous peripheral edge, said channel extending along opposing side portions and a bottom portion of said continuous peripheral edge portion of said main support plate.

18. The attachment of claim 17 wherein said plurality of complementary interfitting structures also includes a peripheral plate attached on and extending radially outward from a rear peripheral edge of said front housing portion surrounding said open rear side thereof, said peripheral plate being installed in a flush relationship along said front side of said main support plate slidably inserted parallel along said front side of said main support plate and interengaged with said channel on said front side of said main support plate so as to attach said front housing portion to said main support plate.

19. The attachment of claim 18 wherein said spaced apart elements are holes formed through said continuous peripheral edge of said main support plate and spaced radially outward from said peripheral plate on said front housing portion of said pencil sharpener holder body.

20. The attachment of claim 15 further comprising a plug insertable in and removable from said aperture through said upper portion of said front housing portion leading into said front chamber.

* * * * *